US008348529B2

(12) United States Patent
Hayashi

(10) Patent No.: US 8,348,529 B2
(45) Date of Patent: Jan. 8, 2013

(54) INK RIBBON CASSETTE AND APPARATUS THAT USES THE INK RIBBON CASSETTE

(75) Inventor: Hiroyuki Hayashi, Fukushima (JP)

(73) Assignee: Oki Data Corporation, Tokyo (JP)

( * ) Notice: Subject to any disclaimer, the term of this patent is extended or adjusted under 35 U.S.C. 154(b) by 1233 days.

(21) Appl. No.: 12/128,912

(22) Filed: May 29, 2008

(65) Prior Publication Data

US 2008/0298869 A1 Dec. 4, 2008

(30) Foreign Application Priority Data

May 29, 2007 (JP) ..... 2007-141822

(51) Int. Cl.

| | |
|---|---|
| ***B41J 35/28*** | (2006.01) |
| ***B41J 32/00*** | (2006.01) |
| ***B41J 32/02*** | (2006.01) |
| ***B41J 33/26*** | (2006.01) |

(52) U.S. Cl. ..... 400/208; 400/196; 400/207; 400/208.1

(58) Field of Classification Search ..... 400/195, 400/196, 208, 196.1, 197, 201, 202, 202.1, 400/202.3, 202.4, 194, 207, 208.1
See application file for complete search history.

(56) References Cited

FOREIGN PATENT DOCUMENTS

| | | | |
|---|---|---|---|
| JP | 07-266672 | * | 10/1995 |
| JP | 08-156377 | * | 6/1996 |
| JP | H8-169167 | | 7/1996 |
| JP | 2001-191625 A | | 7/2001 |

* cited by examiner

*Primary Examiner* — Daniel J Colilla
*Assistant Examiner* — Marissa Ferguson Samreth
(74) *Attorney, Agent, or Firm* — Panitch Schwarze Belisario & Nadel LLP

(57) ABSTRACT

An ink ribbon cassette includes first and second rotatable bodies that rotate with an ink ribbon held between the rotatable bodies in sandwiched relation. The second rotatable body includes a hole through which a shaft extends such that the second rotatable body is rotatably supported on the shaft. The shaft may have a circumferential surface conical toward the free end, and the hole may be a conical hole into which the conical shaft extends. The shaft may include a plurality of cylindrical shaft portions that are in line with one another and that have different diameters. The second rotatable body is formed with a plurality of cylindrical hole portions having different diameters corresponding to the cylindrical shaft portions such that the second rotatable body is rotatably supported on the shaft.

11 Claims, 9 Drawing Sheets

INK RIBBON CASSETTE AND APPARATUS THAT USES THE INK RIBBON CASSETTE

BACKGROUND OF THE INVENTION

1. Field of the Invention

The present invention relates to an ink ribbon cassette that employs a replaceable ink ribbon, and an apparatus that uses the ink ribbon cassette.

2. Description of the Related Art

FIGS. 16-18 illustrate a conventional ink ribbon cassette for use in an impact printer. Referring to FIGS. 16-18, an ink ribbon 104 is sandwiched between a drive gear 102 and a driven gear 103. The drive gear 102 is driven to rotate in a direction shown by arrow A (FIG. 17), thereby driving the ink ribbon 104 to travel in a direction shown by arrow B (FIG. 17). The drive gear 102 and driven gear 103 may be replaced by a feed roller and an idle roller, respectively.

Referring to FIG. 18, a body 106 and a cover 105 have holes formed therein. The drive gear 102 and driven gear 103 have their shafts that extend through the holes such that the drive gear 102 and driven gear 103 are rotatably supported by the body 106 and cover 105.

The conventional ink ribbon cassette is configured such that the drive gear 102 and the driven 103 remain in meshing with each other and rotate on their shafts mounted to the body 106 to advance the ink ribbon 104. An ink ribbon cassette, however, requires some disassembly and reassembly for removal from and installation to the printer. In addition, the installation of the ink ribbon 104 between the drive gear 102 and driven gear 103 requires precise alignment of the ink ribbon 104 with the drive gear 102 and driven gear 103, which is tedious and tends to be difficult for unskilled personnel.

In addition, the ink ribbon 104 sandwiched between the drive gear 102 and driven gear 103, may be wrinkled to cause an ink-ribbon jam.

SUMMARY OF THE INVENTION

The present invention was made in view of the aforementioned drawbacks of a conventional image forming apparatus.

An object of the invention is to provide an ink ribbon cassette in which the ink ribbon may be replaced without difficulty.

An ink ribbon cassette includes rotatable bodies that rotate with an ink ribbon held between the rotatable bodies in sandwiched relation. The ink ribbon cassette includes a first rotatable body and a second rotatable body. The second rotatable body includes a hole through which a shaft extends such that the second rotatable body is rotatably supported on the shaft. The shaft includes a free end and a diameter that is smaller nearer the free end. The hole includes a diameter such that the second rotatable body is rotatably supported on the shaft.

The shaft may be a conical shaft having a circumferential surface conical toward the free end, and the hole is a conical hole into which the conical shaft extends.

The first rotatable body and the second rotatable body are gears that loosely mesh with each other with the ink ribbon sandwiched therebetween.

The second rotatable body is detachably mounted on the shaft.

The shaft may include a plurality of cylindrical shaft portions positioned in line with one another, the cylindrical shaft portions having different diameters. The second rotatable body is formed with a plurality of cylindrical hole portions having different diameters corresponding to the cylindrical shaft portions such that the second rotatable body is rotatably supported on the shaft.

The ink ribbon cassette further includes a housing body in which the first rotatable body and the second rotatable body are accommodated. At least one of the first rotatable body and the second rotatable body includes an annular groove formed in a circumferential surface thereof, the annular groove extending in a circumferential direction of the at least one of the first rotatable body and the second rotatable body. The housing body includes at least one projection that extends into the annular groove.

An apparatus includes an ink ribbon cassette of the aforementioned configuration, and a printing section that prints on a print medium.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Figure 1:
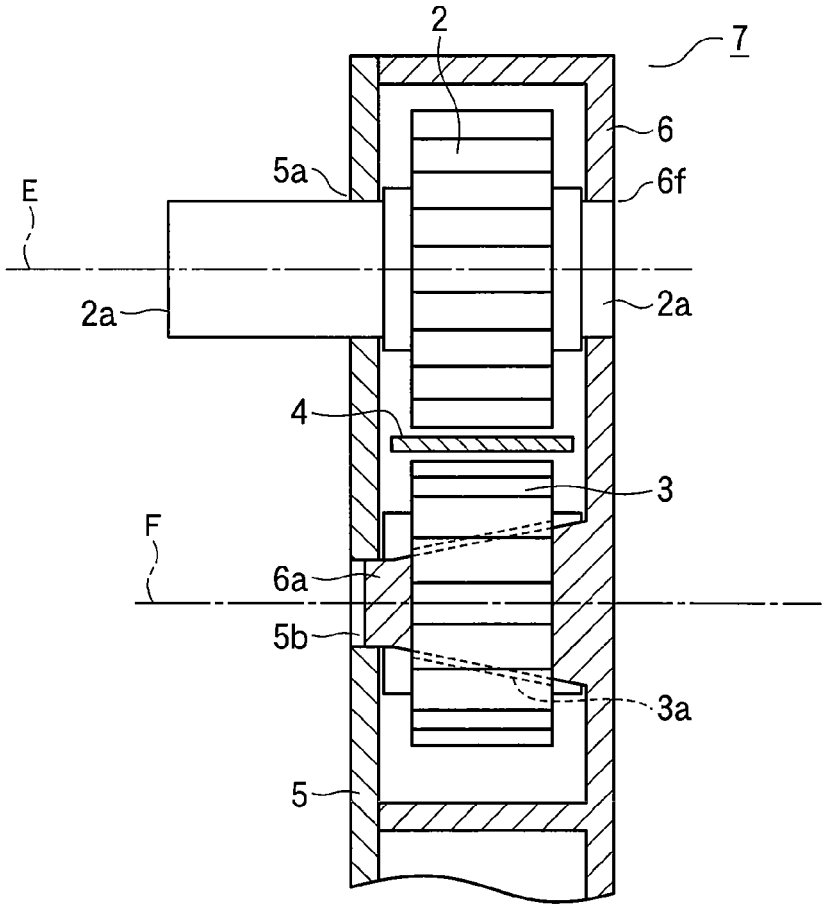
FIG. 1 is a side view of an ink ribbon cassette of a first embodiment.

Embodiments of the invention will be described with reference to the accompanying drawings. Like elements have been given the same reference numerals throughout the drawings.

First Embodiment

Construction

An ink ribbon cassette of a first embodiment is configured as follows: Two gears rotate about substantially parallel axes with an ink ribbon sandwiched between the two gears. One of the two gears includes a conical hole formed therein such that the gear rotates on a conical shaft.

Figure 2:
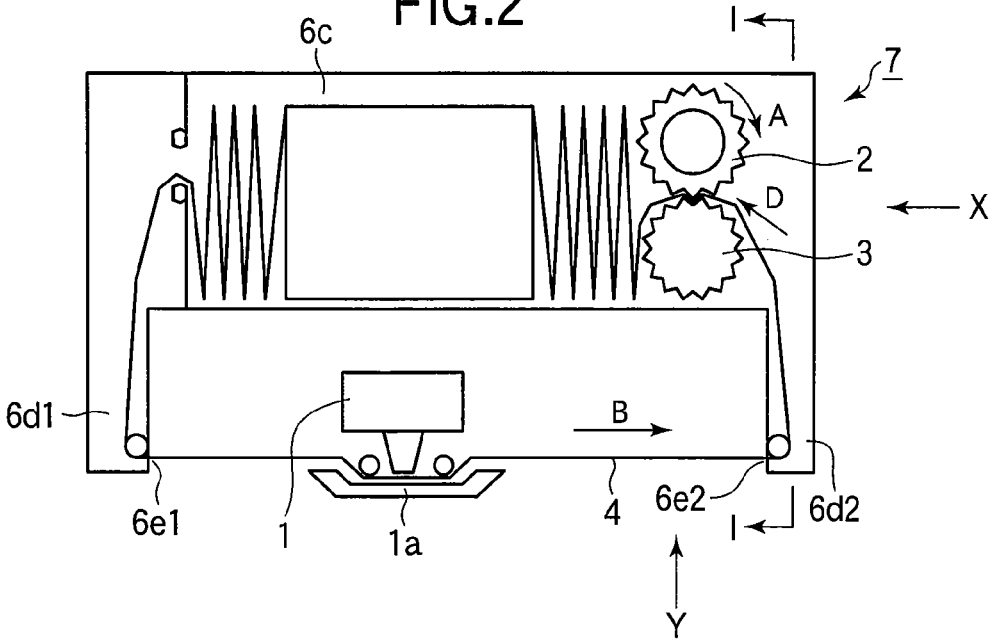
FIG. 2 is a top view of the ink ribbon cassette.

FIG. 1 is a partial cross-sectional side view of an ink ribbon cassette 7 of a first embodiment, taken along a line I-I of FIG. 2. FIG. 2 is a top view of the ink ribbon cassette 7. The ink ribbon cassette 7 includes a body 6 that accommodates an ink ribbon 4, a cover 5 that covers the ink ribbon 4, and a drive gear 2 and a driven gear 3 disposed at one end of the ink ribbon cassette 7.

The drive gear 2 includes a shaft 2*a* having their end portions extending through a hole 6*f* formed in the body 6, and through a hole 5*a* formed in the cover 5. The driven gear 3 has a conical hole 3*a*. A conical shaft 6*a* is formed on the body 6, and extends through the conical hole 3*a* of the driven gear 3 such that the driven gear 3 rotates on the conical shaft 6*a*. The drive gear 2 rotates about an axis E while the driven gear 3 rotates about an axis F. The axes E and F are substantially parallel to each other.

{Operation}

The operation of the ink ribbon cassette 7 of the first embodiment will be described in detail with reference to FIGS. 2-6.

A drive force is transmitted from the printer to the drive gear 2 so that the drive gear 2 rotates in a direction shown by arrow A (FIG. 2). The drive gear 2 cooperates with the driven gear 3 to advance the ink ribbon 4 sandwiched between them in a direction shown by arrow D into an ink ribbon chamber 6*c*.

The ink ribbon 4 advances into the ink ribbon cassette 7 through a hole 6*e*2 formed in an inlet path 6*d*2 close to the drive gear 2. Then, the ink ribbon 4 is pulled in between the drive gear 2 and driven gear 3 entering the ink ribbon chamber 6*c*. Then, the ink ribbon 4 exits the ink ribbon chamber 6*c*, and then exiting the ink ribbon cassette 7 through a hole 6*e*1. The ink ribbon 4 then passes through a gap between a print head 1 and a head protector 1*a* in a direction shown by arrow B, and finally enters the ink ribbon cassette 7 through the hole 6*e*2.

{Replacing Ink Ribbon}

Figure 3:
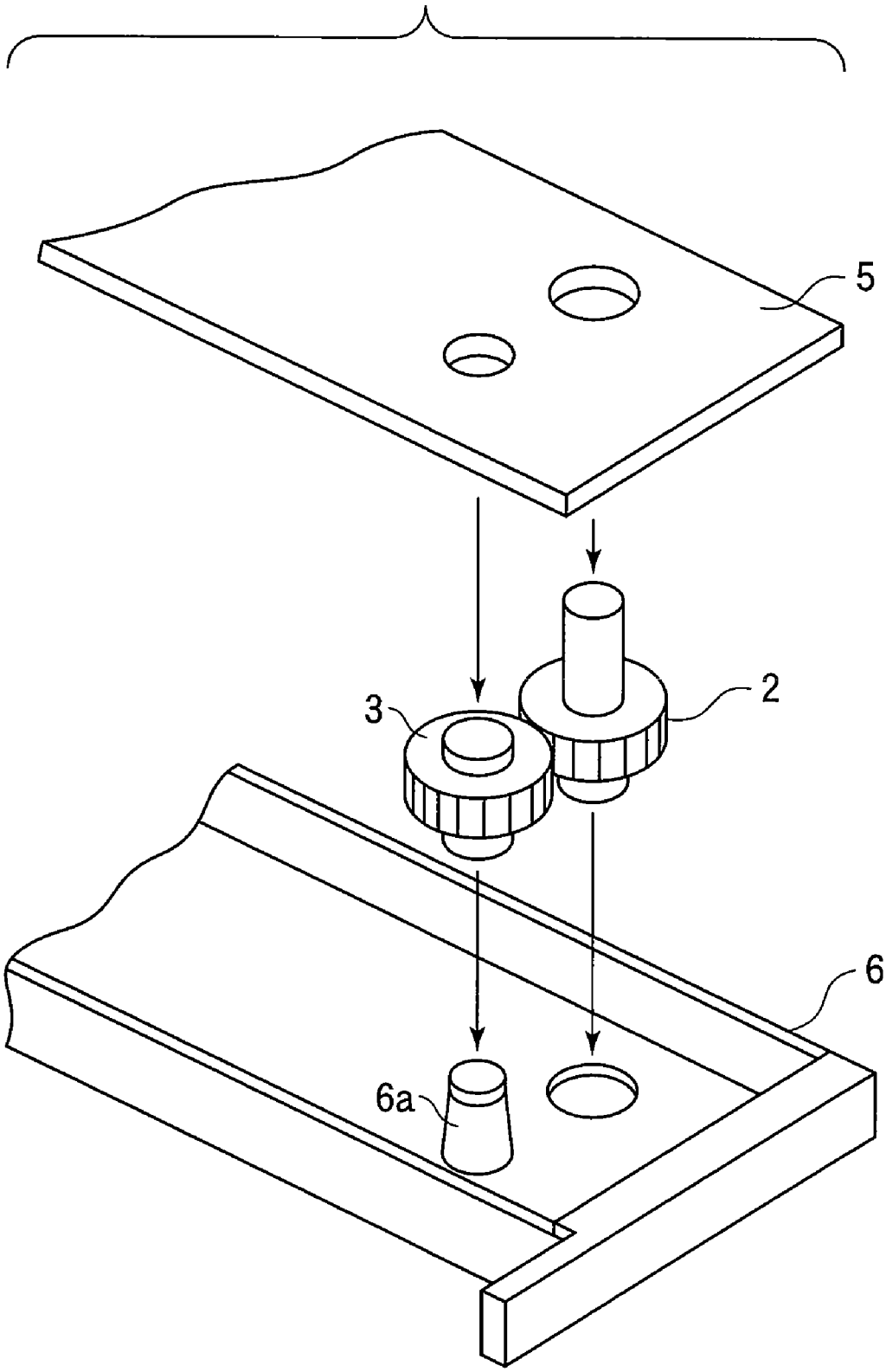
FIG. 3 is an exploded view of the ink ribbon cassette.
Figure 4:
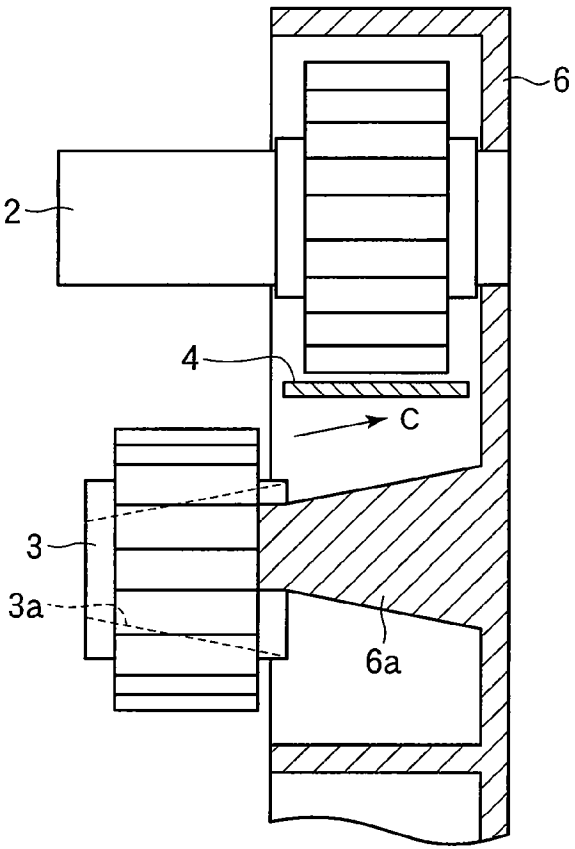
FIG. 4 illustrates mounting of the driven gear.

FIG. 3 is an exploded view of the ink ribbon cassette 7. FIG. 4 illustrates mounting of the driven gear 3. A description will be given of replacement of an old, exhausted ink ribbon 4 with a new, unused ink ribbon 4. When the ink ribbon 4 reaches the end of its useful life, the ink ribbon 4 is unloaded from the gap between the head protector 1*a* and the print head 1 before dismounting the ink ribbon cassette 7 from the printer.

Then, the cover 5 is removed from the body 6, and then the ink ribbon 4 is taken out of the ink ribbon cassette 7. Because the ink ribbon 4 is held between the drive gear 2 and driven gear 3 in sandwiched relation, the driven gear 3 is pulled out before the ink ribbon 4 is taken out of the ink ribbon cassette 7.

A new, unused ink ribbon 4 is set into the ink ribbon cassette 7 as follows: If the drive gear 2 has been dismounted from the ink ribbon cassette 7, the drive gear 2 is first mounted to the ink ribbon cassette 7. Then, the ink ribbon 4 is placed to lie adjacent to the circumferential surface of the drive gear 2 as shown in FIG. 4.

Figure 5:
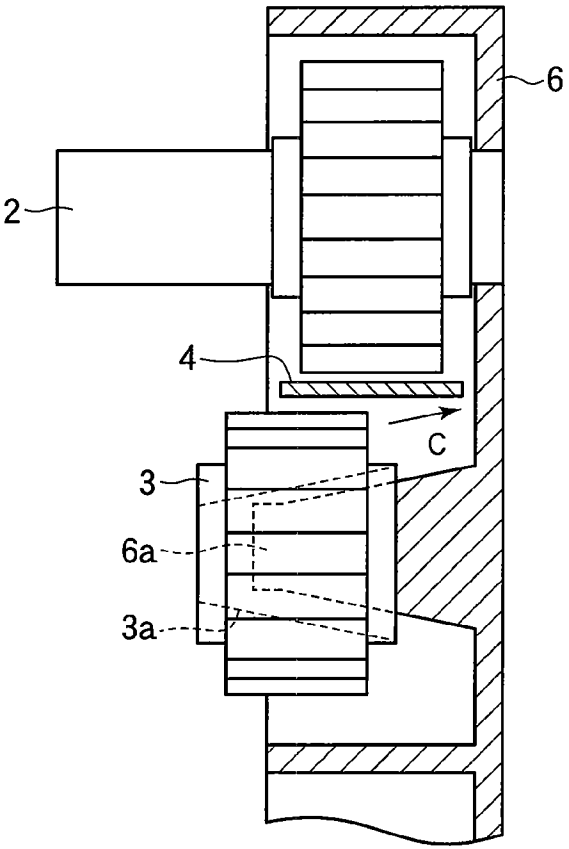
FIG. 5 illustrates mounting of the driven gear sliding along a conical shaft.

FIG. 5 illustrates mounting of the driven gear 3 sliding along the shaft 6*a*. Then, the driven gear 3 is inserted such that the shaft 6*a* extends into the driven gear 3. Because the driven gear 3 has the conical hole 3*a* depicted by a dotted line in FIGS. 4 and 5, the driven gear 3 is mounted to the shaft 6*a*, an area of the conical wall that defines the conical hole 3*a* sliding on the shaft 6*a* in a direction shown by arrow C.

Figure 6:
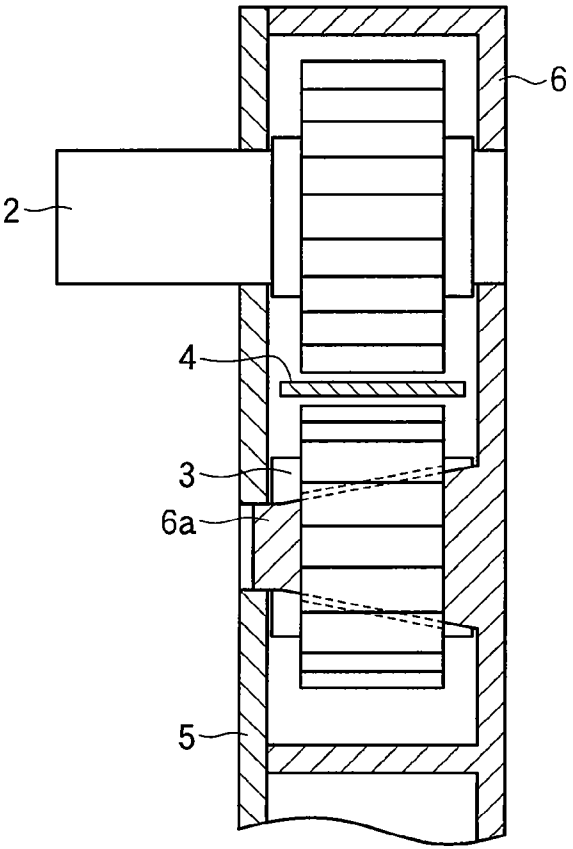
FIG. 6 illustrates the driven gear that has been mounted to the ink ribbon cassette.

FIG. 6 illustrates the driven gear 3 that has been mounted to the ink ribbon cassette 7. Referring to FIG. 6, the ink ribbon 4 is installed into the ink ribbon cassette 7 pressing the ink ribbon 4 against the drive gear 2 with the driven gear 3. Then, the ink ribbon 4 is installed into the ink ribbon chamber 6*c* of the ink ribbon cassette 7. Then, the ink ribbon 4 exits an outlet path 6*d*1 through a left holes 6*e*1, and then enters the inlet path 6*d*2 through a right and 6*e*2. Subsequently, the cover 5 is fitted to the body 6. This completes replacement of the ink ribbon 4.

The driven gear 3 rotatably fits to the shaft 6*a* fixed to the cassette case 6 and the cover 5 fits to the shaft 6*a*, thereby accurately positioning the driven gear 3.

When the driven gear 3 is mounted to the shaft 6*a*, the combination of the conical shaft 6*a* and the conical hole of the driven gear 3 provides a large gap between the driven gear 3 and drive gear 2. This facilitates replacement of the ink ribbon 4.

The ink ribbon 4 may be mounted to the ink ribbon cassette 7 without being wrinkled, being free from an ink ribbon jam.

No particular holder or spring is required for providing a space between the driven gear 3 and drive gear 2 which would otherwise be necessary for accommodating the ink ribbon 4 prior to installment of the ink ribbon 4 to the ink ribbon cassette 7. Thus, the ink ribbon cassette 7 may be manufactured at low cost.

The first embodiment has been described with respect to the driven gear 3 having a conical hole fitted over the conical shaft 6*a*, the drive gear 2 may also have a conical hole and be fitted over a conical shaft.

Second Embodiment

An ink ribbon cassette of a second embodiment is configured as follows: Two gears rotate about substantially parallel axes with an ink ribbon sandwiched between the two gears. One of the two gears includes more than one holes in line with one another formed therein such that the gear fits over a shaft having more than one cylindrical shaft portions.

{Construction}

Figure 7:
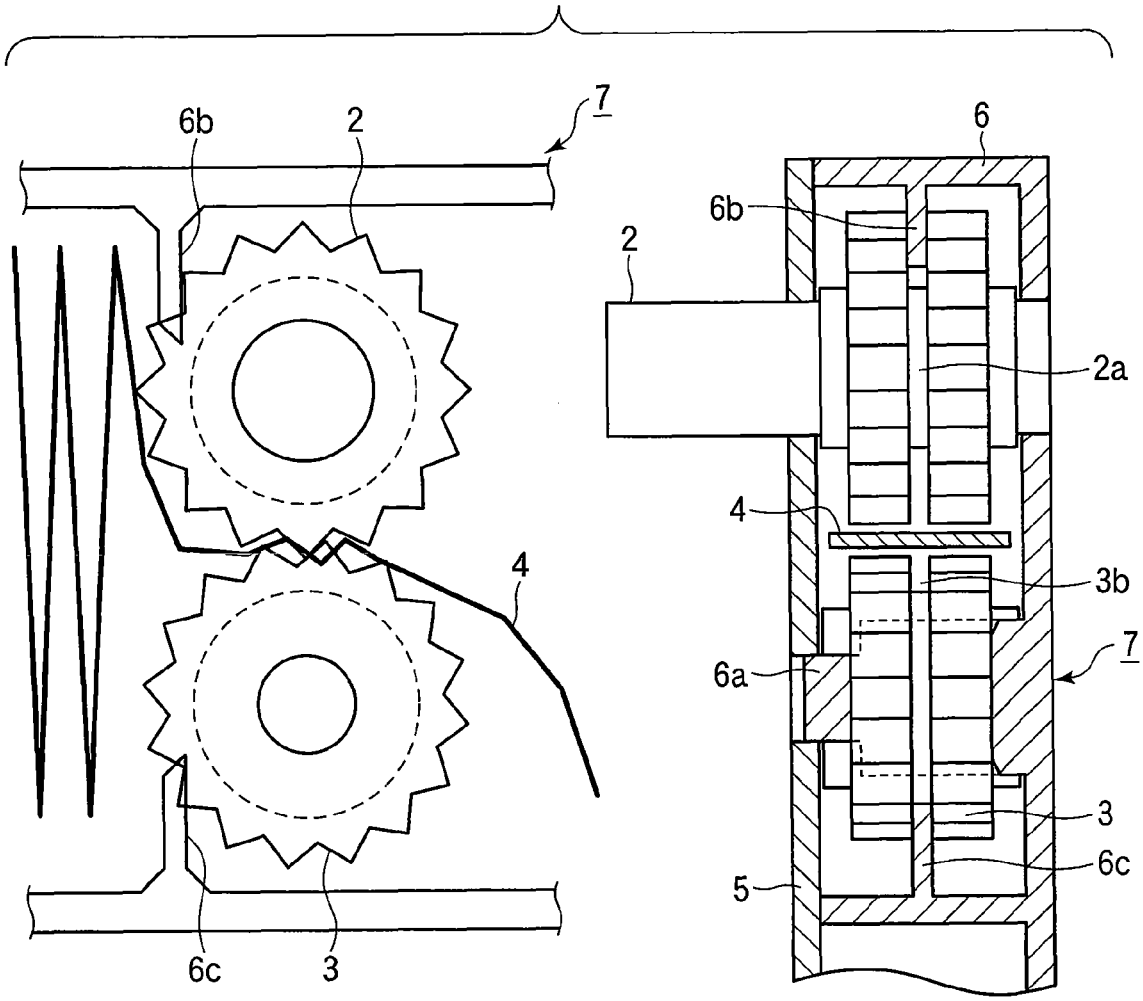
FIG. 7 is a cross-sectional side view of a second embodiment, illustrating a driven gear that has been mounted to an ink ribbon cassette.
Figure 8:
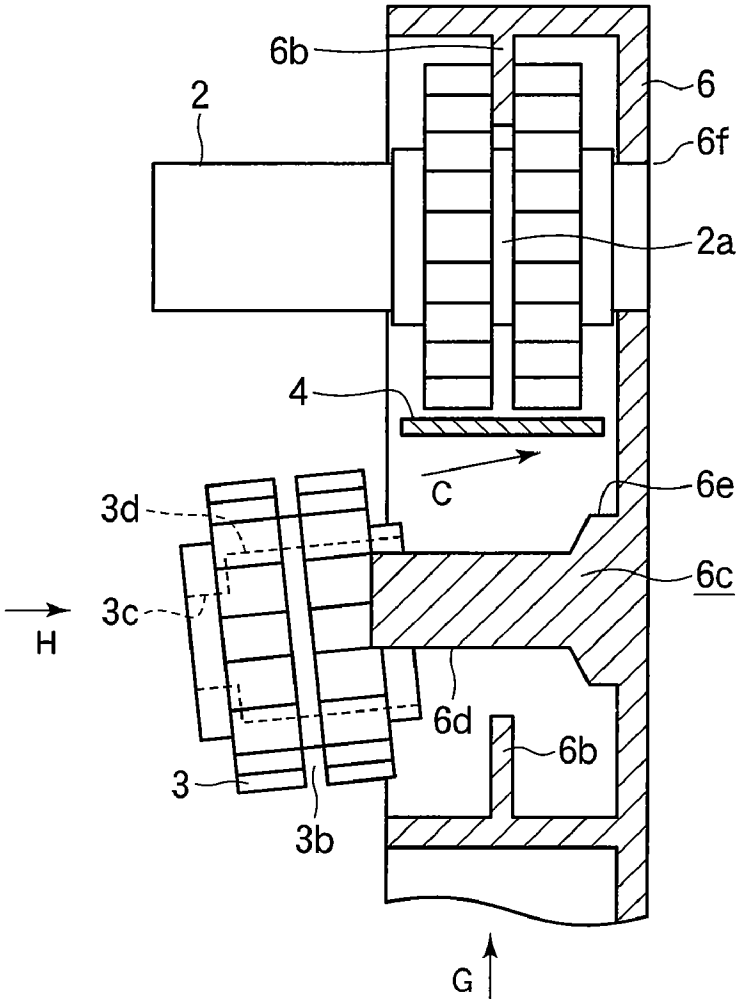
FIG. 8 illustrates mounting of the driven gear of FIG. 7 to the ink ribbon cassette.

FIG. 7 illustrates the driven gear 3 that has been mounted to an ink ribbon cassette 7. FIG. 8 illustrates mounting of the driven gear 3 to the ink ribbon cassette 7. The ink ribbon cassette 7 of a second embodiment prevents wrapping of an ink ribbon 4 around a driven gear 3 and a drive gear 2, as well as facilitates smooth advancing of the ink ribbon 4 in the ink ribbon cassette 7. The drive gear 2 and driven gear 3 have annular grooves 2*a* and 3*b*, respectively, formed to extend in a circumferential direction of the drive gear 2 and driven gear 3. Projections 6*a* and 6*b* extend from a body 6 into the annular grooves 2*a* and 3*b*, respectively. When the driven gear 3 and drive gear 2 rotate with the ink ribbon 4 wrapping around them, the projections 6*a* and 6*b* engage the ink ribbon 4 to cause the ink ribbon 4 to be unwrapped.

The driven gear 3 has a small diameter hole 3*c* and a large diameter hole 3*d* through which the shaft 6*c* extends. The small diameter hole 3*c* and large diameter hole 3*d* are positioned in line with each other and are in communication with each other. The driven gear 3 rotates on a shaft 6*c* formed on an inner wall of the body 6. The shaft 6*c* differs from the shaft 6*a* of the first embodiment in that the shaft 6*c* has a small diameter cylindrical portion 6*d* and a large diameter cylindrical portion 6*e*. When the driven gear 3 has been fitted onto the shaft 6*c*, the large diameter portion 6*e* loosely fits into the large diameter hole 3*d* of the driven gear 3 and the small diameter cylindrical portion 6*d* loosely fits into the small diameter hole 3*c*. The small diameter cylindrical portion 6*d* and large diameter cylindrical portion 6*e* are positioned in line with each other.

Figure 15:
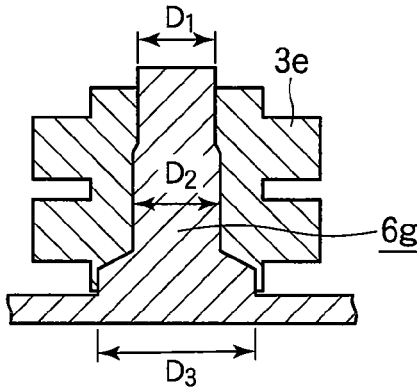
FIG. 15 illustrates modifications to the shaft and the driven gear of the second embodiment.
Figure 16:
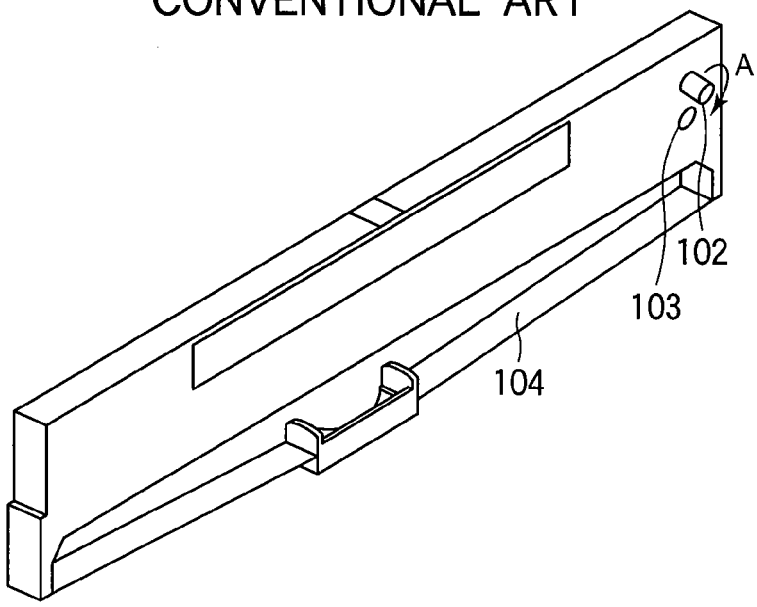
FIG.16 CONVENTIONAL ART
FIGS. 16-18 illustrate a conventional ink ribbon cassette for use in an impact printer.
Figure 17:
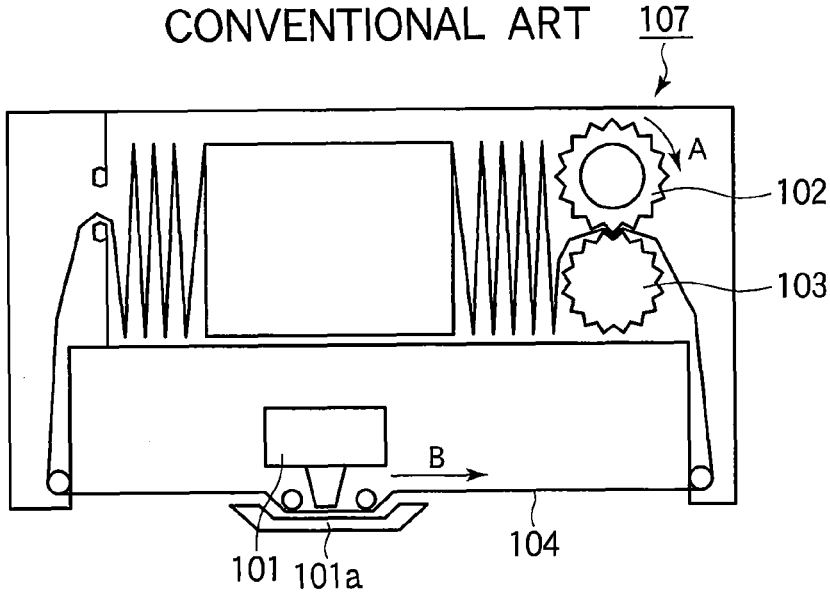
FIG.17 CONVENTIONAL ART
Figure 18:
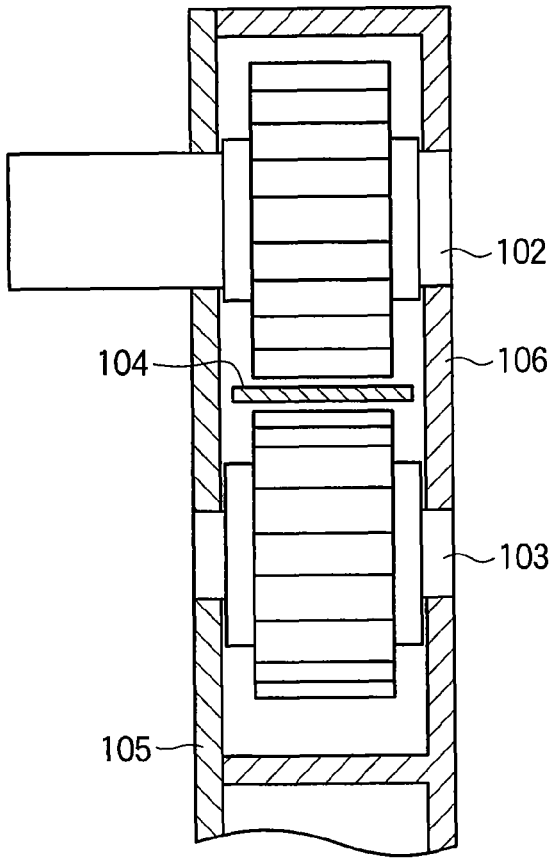
FIG.18 CONVENTIONAL ART

FIG. 15 illustrates modifications to the shaft 6*c* and the driven gear 3. The driven gear 3 may have a larger number of different diameter holes, and the shaft 6*c* may have a larger number of different diameter portions as long as the drive gear 3 may be mounted to the shaft 6*c* without difficulty. Referring to FIG. 15, a shaft 6*g* includes three shaft portions having different diameters D1, D2, and D3 such that their diameters are smaller nearer a free of the shaft 6*g*. The diameters D1, D2, and D3 are related such that D1<D2<D3. A driven gear 3*e* includes three hole portions having different diameters slightly larger than the diameter D1, D2, and D3 such that the driven gear 3 rotatably fits over the shaft 6*g*.

The remaining portion of the second embodiment is the same as that of the first embodiment, and the description is omitted.

{Assembling Drive Gear and Driven Gear}

Figure 9:
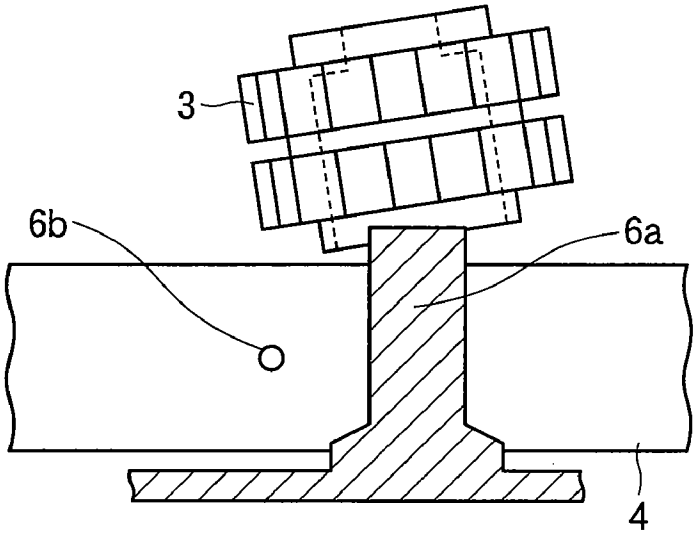
FIG. 9 illustrates mounting of the driven gear to the ink ribbon cassette as seen in a direction shown by arrow G of FIG. 8.
Figure 11:
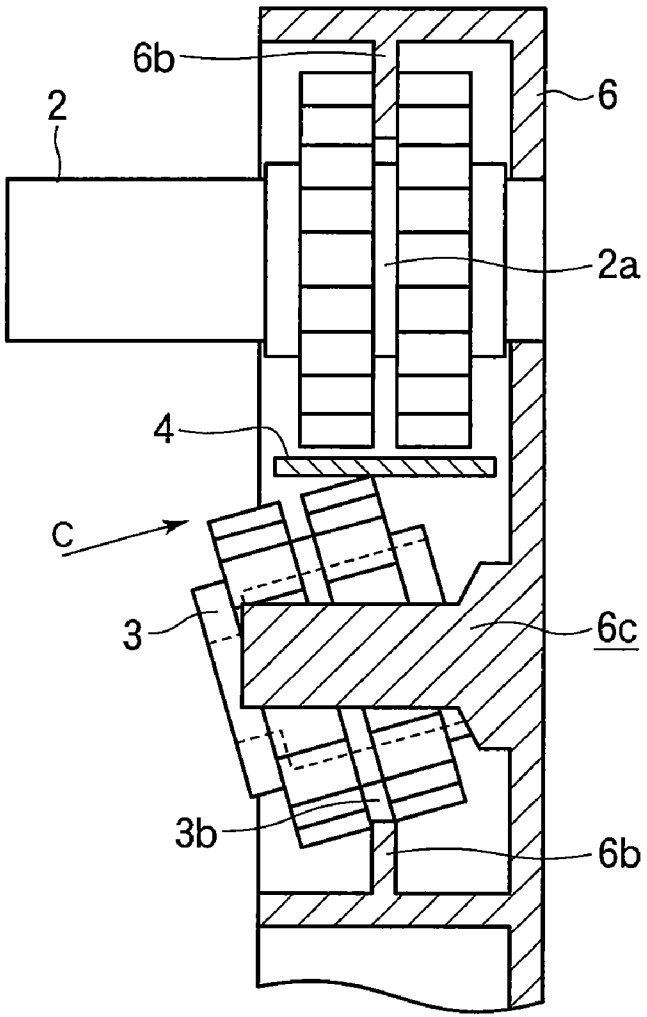
FIG. 11 illustrates the driven gear when it is further inserted into the ink ribbon cassette.
Figure 10:
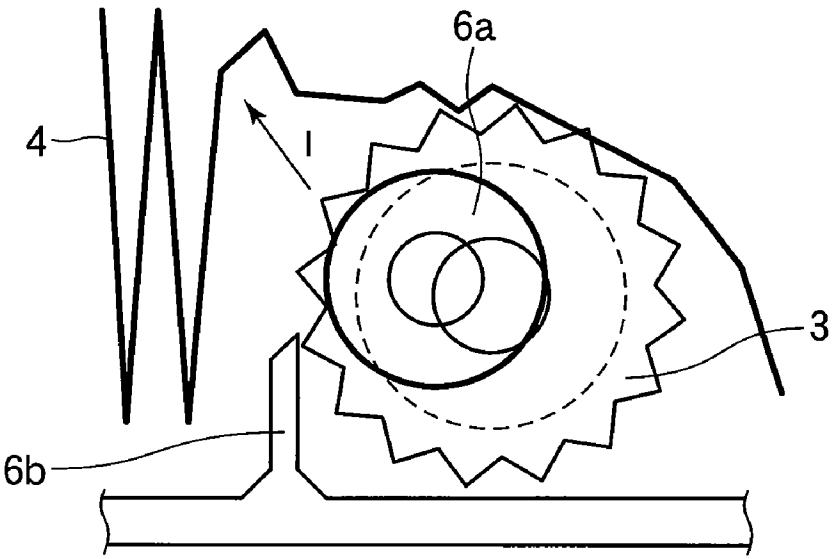
FIG. 10 illustrates mounting of the driven gear to the ink ribbon cassette as seen in a direction shown by arrow H of FIG. 8.

FIG. 9 illustrates mounting of the driven gear 3 to the ink ribbon cassette 7 as seen in a direction shown by arrow G of FIG. 8. FIG. 10 illustrates mounting of the driven gear 3 to the ink ribbon cassette 7 as seen in a direction shown by arrow H of FIG. 8. FIG. 11 illustrates the driven gear 3 when it is further inserted into the ink ribbon cassette 7. The assembly the drive gear and driven gear of the second embodiment will be described in detail with reference to FIGS. 8-14. The operation for advancing the ink ribbon 4 is the same as that of the first embodiment and the description is omitted.

Referring to FIG. 8-11, the drive gear 2 is first mounted to the body 6. Then, the operator holds the drive gear 2 in such a way that the projection 6*b* enters the annular groove 2*a* and the shaft of the drive gear 2 enters the hole 6*f* formed in the body 6. Then, the operator positions the drive gear 2 at the normal position (FIG. 8).

When the driven gear 3 is mounted to the shaft 6*c*, the driven gear 3 is first fitted over the small diameter portion 6*d* of the shaft 6*c*. At this moment, a large enough gap may be available between the driven gear 3 and drive gear 2 so that the ink ribbon 4 may be received comfortably in the gap. Then, the operator slowly moves the driven gear 3 in directions shown by arrow I (FIG. 10) and arrows C (FIG. 8) such that the projection 6*c* enters the annular groove 3*b* in the driven gear 3, with the small diameter portion 6*d* extending into the hole 3*d* of the driven gear 3.

Figure 12A:
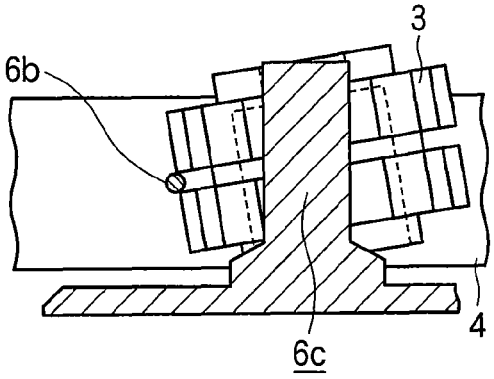
FIGS. 12A and 12B illustrate the driven gear that further fits into the ink ribbon cassette such that the projection extends into an annular groove formed in the driven gear.
Figure 12B:
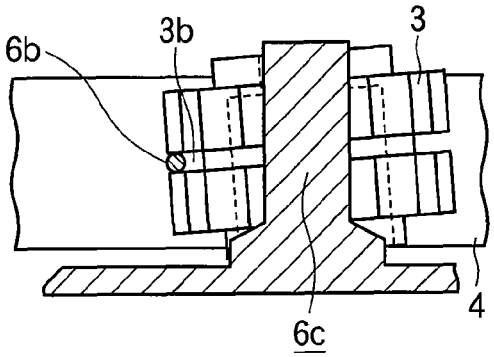

FIGS. 12A and 12B illustrate the driven gear 3 that further fits into the ink ribbon cassette 7 such that the projection 6*b* extends into the annular groove 3*a*. Then, the operator inserts the driven gear 3 into the ink ribbon cassette 7 so that the driven gear 3 further fits over small diameter portion 6*d* to receive the projection 6*b* in the annular groove 3*b*.

Figure 13:
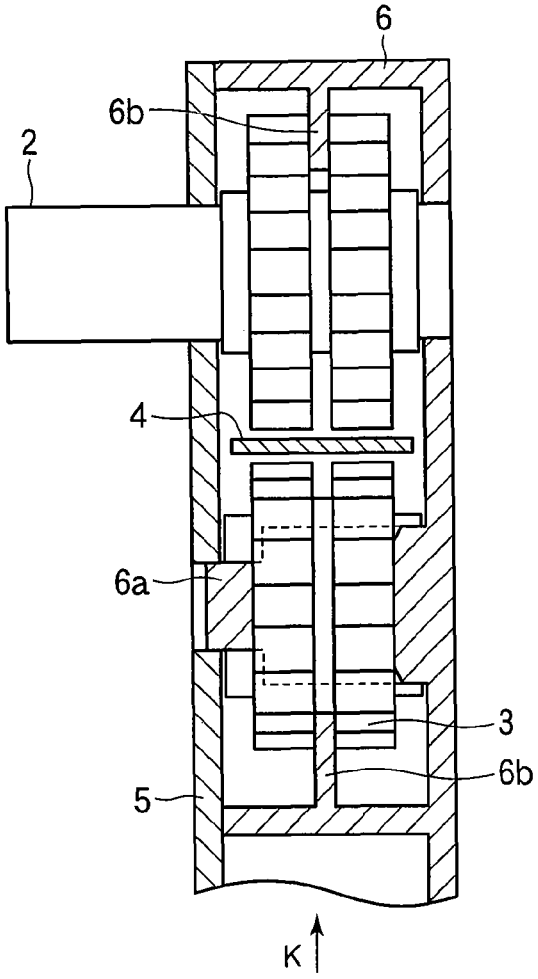
FIG. 13 illustrates the driven gear that has been completely mounted to the ink ribbon cassette.
Figure 14:
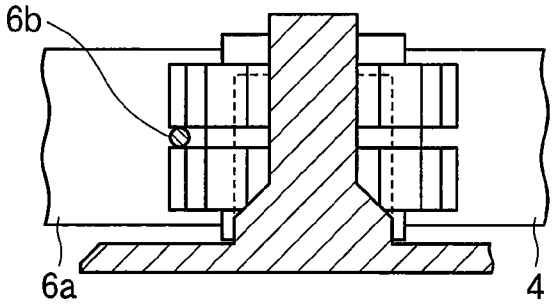
FIG. 14 illustrates the driven gear and the ink ribbon as seen in a direction shown by arrow G of FIG. 8.

FIG. 13 illustrates the driven gear 3 that has been mounted to the ink ribbon cassette 7. FIG. 14 illustrates the driven gear 3 and the ink ribbon 4 as seen in a direction shown by arrow K of FIG. 13.

Finally, the driven gear 3 is pressed into the body 6 until the driven gear 3 loosely fits over the large diameter portion 6*e* as shown in FIGS. 13 and 14. This completes assembly of the drive gear 2 and driven gear 3.

Inserting the driven gear 3 into the body 6 in the D direction allows the driven gear 3 to be assembled to the body 6 without interfering with the ink ribbon 4, thereby ensuring reliable installation of the ink ribbon 4 between the drive gear 2 and driven gear 3.

As described above, the shaft 6*a* for the driven gear 3 includes the small diameter cylindrical portion 6*d* and the large diameter cylindrical portion 6*e*. The driven gear 3 has the small diameter hole 3*c* and the large diameter portion 3*d*. This structure not only allows smooth and easy mounting of the ink ribbon 4 into a gap between the drive gear and driven gear, but prevents the ink ribbon 4 from wrapping around the driven gear 3 and drive gear 2.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An ink ribbon cassette comprising:

a first rotatable body;

a second rotatable body comprising a hole that includes a large diameter end portion and a small diameter end portion;

an ink ribbon held between the first rotatable body and the second rotatable body in a sandwiched relationship; and a shaft on which the second rotatable body is rotatably supported, the shaft comprising a free end, a small diameter portion and a large diameter portion, the small diameter portion being closer to the free end than the large diameter portion, wherein the small diameter end portion of the hole of the second rotatable body is fitted with the small diameter portion of the shaft and the large diameter end portion of the hole of the second rotatable body is fitted with the large diameter portion of the shaft.

2. The ink ribbon cassette according to claim 1, wherein the second rotatable body is detachably mounted on the shaft.

3. The ink ribbon cassette according to claim 2, wherein the shaft is a conical shaft having a circumferential surface conical toward the free end, and the hole is a conical hole into which the conical shaft extends.

4. The ink ribbon cassette according to claim 3, wherein the first rotatable body and the second rotatable body are gears that loosely mesh with each other with the ink ribbon sandwiched therebetween.

5. An apparatus comprising an ink ribbon cassette according to claim 3, and a printing section that prints on a print medium.

6. The ink ribbon cassette according to claim 2, wherein the shaft is a cylindrical shaft having a circumferential surface cylindrical toward the free end, and the hole is a cylindrical hole into which the cylindrical shaft extends.

7. The ink ribbon cassette according to claim 6, wherein the first rotatable body and the second rotatable body are gears that mesh with each other with the ink ribbon sandwiched therebetween.

8. The ink ribbon cassette according to claim 6, wherein the shaft includes a plurality of cylindrical shaft portions positioned in line with one another, the cylindrical shaft portions having different diameters;

wherein the second rotatable body is formed with a plurality of cylindrical hole portions having different diameters corresponding to the cylindrical shaft portions such that the second rotatable body is rotatably supported on the shaft.

9. The ink ribbon cassette according to claim 1, further comprising a housing body in which the first rotatable body and the second rotatable body are accommodated;

wherein at least one of the first rotatable body and the second rotatable body includes an annular groove formed in a circumferential surface thereof, the annular groove extending in a circumferential direction of the at least one of the first rotatable body and the second rotatable body; and wherein the housing body includes at least one projection that extends into the annular groove.

10. An apparatus comprising an ink ribbon cassette according to claim 1, and a printing section that prints on a print medium.

11. An ink ribbon cassette according to claim 1, wherein the second rotatable body is a gear.

* * * * *